United States Patent [19]

Bindra et al.

[11] Patent Number: 5,035,778

[45] Date of Patent: Jul. 30, 1991

[54] REGENERATION OF SPENT FERRIC CHLORIDE ETCHANTS

[75] Inventors: Perminder Bindra, Vestal; Kathleen L. Covert, Kirkwood, both of N.Y.; David N. Light, Friendsville, Pa.

[73] Assignee: International Business Machines Corporation, Armonk, N.Y.

[21] Appl. No.: 350,971

[22] Filed: May 12, 1989

[51] Int. Cl.[5] ..... C25B 1/26

[52] U.S. Cl. ..... 204/94; 204/130

[58] Field of Search ..... 204/94, 130

[56] References Cited

U.S. PATENT DOCUMENTS

| | | | |
|---|---|---|---|
| 2,748,071 | 5/1956 | Eisler | 204/208 |
| 3,622,478 | 11/1971 | Beyer | 204/130 |
| 3,761,369 | 9/1973 | Tirrell | 204/151 |
| 3,788,959 | 1/1974 | Smith | 204/130 |
| 3,964,956 | 6/1976 | Snyder | 156/345 |
| 4,269,678 | 5/1981 | Faul et al. | 204/129.6 |
| 4,396,475 | 8/1983 | Stehlik | 204/130 |
| 4,468,305 | 8/1984 | Hillis | 204/130 |
| 4,765,728 | 8/1988 | Hamano et al. | 204/130 |

FOREIGN PATENT DOCUMENTS

| | | |
|---|---|---|
| 018848 | 11/1980 | European Pat. Off. . |
| 2726622 | 12/1978 | Fed. Rep. of Germany . |

*Primary Examiner*—T. Tung

*Attorney, Agent, or Firm*—Pollock, Vande Sande & Priddy

[57] ABSTRACT

Spent ferric chloride etching compositions are regenerated by electrolysis which includes introducing spent ferric chloride etching composition containing total iron content substantially equal to the original total iron content of fresh etching composition into the anode compartment of an electrolysis cell that contains an anode compartment, a cathode compartment, and an anion-exchange membrane separating the compartments, and applying voltage of +0.6 to +1.5 volts versus a saturated calomel electrode to the anode.

13 Claims, No Drawings

REGENERATION OF SPENT FERRIC CHLORIDE ETCHANTS

DESCRIPTION

1. Technical Field

The present invention is concerned with an electrolytic process for regenerating spent ferric chloride etching compositions. In particular, the present invention is concerned with an electrolytic process for regenerating spent ferric chloride compositions without concomitantly generating chlorine gas.

The present invention is concerned with an electrolytic regeneration process for ferric chloride solutions that is highly efficient and can be carried out at relatively rapid rates.

2. Background Art

Ferric chloride compositions are extensively used commercially such as to etch various metals including steel, copper, and aluminum.

For example, the etching of steel employing ferric chloride solutions is important in the manufacture of stainless steel print bands for impact printers and for integrated chip carriers.

The activity of ferric chloride compositions diminishes over a period of time of use until it reaches a point where etching with the composition is no longer satisfactory. The decay or diminishing of activity is due to the reduction of the active ferric ion to the relatively inactive ferrous ion caused by the etching reaction itself. As the etch rate decreases, the amount of metal removed per unit time likewise decreases and, therefore, the quality or throughput must then suffer. However, frequent dumping of the etch bath becomes a problem since it leads to large volumes of waste products that must be treated before being transported as sludge. The treatment of the waste products is a relatively costly matter.

There have been various suggestions to chemically regenerate ferric chloride solutions. Such suggestions have included oxidizing with an oxidizing agent such as chlorine, ozone, or hydrogen peroxide. However, these methods are not desirable in view of safety and environmental concerns. It has also been suggested to regenerate ferric chloride solutions by aerating or oxygenating. However, these procedures tend to be relatively slow and do not adequately keep up with the rate of formation of ferrous ion during high volume etching procedures.

More recently, there have been suggestions to employ electrolytic regeneration of certain ferric chloride compositions. However, the processes suggested are not entirely satisfactory from a standpoint of efficiency and safeness. Also, many of the suggested processes for electrolytic regeneration result in the generation of a significant amount of chlorine gas at the anode.

SUMMARY OF INVENTION

The present invention provides an electrolytic process for regenerating ferric chloride solution that is highly efficient, safe to carry out, relatively fast, and does not concomitantly produce chlorine. The electrolytic regeneration process of the present invention is compatible with high volume manufacturing processes since the process of the present invention can be carried out at a relatively high rate. Furthermore, in view of the extremely high efficiency achieved by the process of the present invention, the process is quite compatible for those industrial processes where high quality with low tolerance processing must be observed.

More particularly, the method of the present invention is concerned with regenerating a spent ferric chloride etching composition without generating chlorine gas. The method comprises providing an electrolysis cell having an anodic compartment containing an anode, a cathodic compartment containing a cathode, and an anion-exchange membrane that separates the anodic compartment from the cathodic compartment. Spent ferric chloride etching composition is introduced into the anodic compartment of the electrolysis cell. The spent ferric chloride composition employed has a total iron content that is at least substantially equal (e.g. $\pm 10\%$) to the original total iron content of fresh ferric chloride etching composition. A catholyte composition is provided in the cathodic compartment of the electrolysis cell. A voltage of $+0.6$ volts to $+1.5$ volts versus a saturated calomel electrode (SCE) is applied to the anode. The spent ferric chloride is thereby regenerated to provide the ferric chloride etching composition.

BEST AND VARIOUS MODES FOR CARRYING OUT INVENTION

The process of the present invention is carried out in an electrolytic cell. Electrolytic cells are well known and commercially available. Therefore, a detailed discussion of such is not deemed necessary. The preferred type of cell used is referred to as a plate and frame flow cell. Such are commercially available, for instance, from Electrocell AB, Okersbergo Sweden under the trade designation ElectroProd cell. Of course, other types of cells such as 2-chamber tank type systems can be used if desired. In any event, the electrolytic cell will include a cathodic compartment that includes a cathode, an anodic compartment that includes an anode and an ion exchange membrane separating the cathodic compartment from the anodic compartment.

When the cathode reaction is the reduction of $Fe^{3+}$ to $Fe^{2+}$ such as in excess spent etchant, the cathode is preferably composed of graphite felt which is a high surface area graphite. Graphite felt is preferred when $Fe^{3+}$ reduction is the cathode reaction since it gives high efficiency with minor side reactions such as hydrogen generation. Examples of other cathode materials are other types of carbon and precious metal cathodes such as gold and platinum. However, platinum is desirable only when hydrogen evolution is the preferred cathode reaction such as the neutralization of spent acids.

In plate and frame type flow cells, from about 0.5 to about 10 liters of cell volume per square meter of anode area are normally employed. The cell volume will depend upon the amount of flow desired, spacing of electrodes, and membrane employed. Also, the electrode area depends upon the amount of regeneration desired per unit time. These can be readily determined by persons skilled in the art once aware of this disclosure without undue experimentation. The process of the present invention can be carried out in equipment other than that discussed herein such as a simple 2-chamber tank-type system.

The anode material employed should preferably inhibit chlorine evolution while, at the same time, catalyzing the oxidation of ferrous to ferric ions. A preferred anode material is available under the trade designation DSA® oxygen pH $<2$ which refers to a dimensionally stable anode and is composed of platinum and iridium oxide on titanium. The pH <2 type has a platinum or palladium underlayer between the titanium and platinum-iridium oxide layer. Other anode materials include valve metals such as titanium, zirconium, tantalum, and hafnium and alloys thereof as well as various carbon and graphite electrodes. In addition, the anode can include a non-passivatable material that is resistant to the anodic conditions such as, for example, an oxide or mixed oxide of at least one metal belonging to the platinum groups such as a ruthenium and titanium mixed oxide.

Separating the anodic and cathodic compartments from each other is an ion exchange membrane. The ion exchange membrane is an anion exchange material in order to prevent transport of iron ions across the membrane so as to maintain near 100% efficiency for the process. Anion exchange membranes commercially available include Raipore 1035, ESC 7001, Ionac, and preferably the Neosepta membranes including Neosepta AFN-17 and Neosepta AFN-32. These Neosepta membranes have a polydivinyl benzene backbone having quaternary or tertiary ammonium salt ion exchange groups. The preferred ion exchange membranes permit high current flow along with high selectivity in the process of the present invention. Another suitable ion exchange membrane from Ionics is designated 111 BZL 183 and such is essentially a polymer of vinyl compounds containing quaternary ammonium groups and tertiary amine groups.

The membrane area for a typical cell of the type discussed herein is typically approximately equivalent to the anode area.

The sidewalls of the cells are usually made of a non-corrosive non-conductive material such as polypropylene, polyvinyl chloride and teflon. The anolyte employed is the spent etchant. The spent ferric chloride etching composition employed will have a total iron content ($Fe^{3+}$ and $Fe^{2+}$ ) that is substantially equal ($\pm 10\%$) and preferably equal to the original total iron content of fresh etchant. This total iron content is typically maintained since one way of carrying out the actual etching involves monitoring the specific gravity of the etchant and maintaining it at or near the original value by adding water when needed. The measure of the specific gravity will reflect the total iron content of the composition. In the event the spent etchant to be regenerated is not from a process whereby the original total iron content was maintained, then the spent etchant employed will be one that is diluted with water. In such instance, the spent etchant is usually diluted with water and HCl by about 1/10 to about $\frac{1}{4}$ (i.e.—to about 90% to about 75% of the original) and preferably about $\frac{1}{8}$ to about $\frac{1}{4}$. The dilution of the volume of the spent etchant in such situation is necessary in order to prevent excessive cell voltages during regeneration.

The following is a brief discussion of the manner in which the magnitude of the dilution of the spent etchant can be determined for achieving those aspects of the present invention when it is necessary to dilute the spent etchant. For simplicity, it will be assumed that the stainless steel being etched is 100% iron. In addition, it is assumed that the concentration of ferric ions in a fresh etchant is $M_1$ and the etchant volume is $V_1$ liters. The chloride ion concentration is greater than the concentration of ferric ions and is given the value $N_1$. In the event $\frac{1}{2}$ ($M_1$) ferric ions are employed to dissolve iron from the material being etched, then the composition of the spent etchant is equal to $M_1/2$ (ferric ion) plus $\frac{3}{4}$ ($M_1$) (ferrous ion) plus $N_1$ (chloride ion) plus ($N_1-3M_1$) (hydrogen ion). The volume of the spent etchant is approximately $V_1$ which is the volume of the fresh etchant. As a result of the etching reaction, the combined concentration of ferric ion and ferrous ions has increased to 5/4 $M_1$. Therefore, in order to efficiently regenerate the spent etchant composition, it is necessary to restore the total iron concentration back to $M_1$ before the regeneration. This is achieved by adding to the spent ferric chloride etching composition $\frac{1}{4}$ ($V_1$) liters of ($N_1-3M_1HCl$). The anion exchange membrane will allow transport of exactly enough $Cl^-$ during regeneration to compensate for the chloride associated with $Fe^{3+}$ ($FeCl_3$) but will not compensate for the original HCl. Diluting with ($N_1-3M_1$)HCl prevents dilution of the original HCl.

Since the anion exchange membrane employed results in the transport of charge across the membrane due to the flow of $Cl^-$ from the catholyte to the anolyte, the $Cl^-$ concentration of the anolyte of $N_1$ will be achieved upon completion of the regeneration.

The total volume of solution after the dilution with water is 5/4 $V_1$ liters. However, only $V_1$ liters of the diluted composition are transferred to the anodic compartment of the electrolytic cell. This will ultimately result in the original volume of etchant being regenerated. If desired, the catholyte employed can include the remainder one-fourth ($V_1$) liters of spent etchant and preferably $\frac{3}{4}$ $V_1$ liters of $N_1HCl$. The additional HCl is added to the catholyte in the cathodic compartment of the cell in order to ensure that the volume of electrolytes in the two chambers is the same and equal to $V_1$ liters.

Furthermore, the introduction of additional HCl is preferred in the catholyte since such increases the concentration of transport species and prevents the cathodic reaction from becoming the "bottleneck" during the anodic regeneration reaction or from increasing the cell voltage substantially. Accordingly, the above procedure results in an anolyte composition containing 2/5 $M_1$ ferric ions, 3/5 $M_1$ ferrous ions, and $N_1$ chloride ions; while the catholyte includes 1/10 $M_1$ ferric ions, 3/20 $M_1$ ferrous ions, and $N_1$ chloride ions.

In any event, the preferred catholyte is excess spent etchant formed from etching iron, diluted with water and HCl.

In the anodic compartment, the spent ferric chloride of the original composition is regenerated by the following oxidation reaction:

$$Fe^{+2} \rightarrow Fe^{+3} + e^-$$

The competing reactions are:

$$2Cl^- \rightarrow Cl_2 + 2e^-$$

and $$H_2O \rightarrow 4H^+ + O_2 + 4e^-$$

However, these competing reactions are avoided by controlling the potential at the anode between +0.6 volts to +1.5 volts versus a saturated calomel electrode.

The particular potential employed will vary depending upon the anode material with the optimum value being obtainable by persons skilled in the art without undue experimentation once aware of this disclosure. For instance, with a DSA ® anode the preferred potential is +0.6 to +1.4 volts versus a saturated calomel electrode. For reticulated vitreous carbon, the potential is +1.0 to 1.5 volts versus a saturated calomel electrode. For platinum-iridium on titanium, the potential is +0.6 to +1.1 volts versus a saturated calomel electrode, and for graphite it is +0.8 to 1.2 volts versus a saturated calomel electrode.

In the cathodic compartment, the desired reactions are as follows:

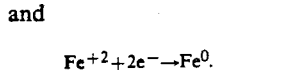

$$Fe^{+3}+e^{-}\rightarrow Fe^{+2}$$

and

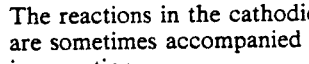

$$Fe^{+2}+2e^{-}\rightarrow Fe^{0}.$$

The reactions in the cathodic compartment of the cell are sometimes accompanied by the following competing reaction:

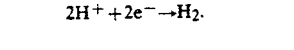

$$2H^{+}+2e^{-}\rightarrow H_2.$$

As discussed above, the charge neutrality in each compartment of the cell is maintained by the transfer of ions across the ion exchange membrane. In particular, with the anion exchange membrane neutrality is accomplished by the transfer of $Cl^-$ ions from the cathodic compartment to the anodic compartment. This $Cl^-$ transfer is equivalent to the amount required to bring the total $Cl^-$ back to $N_1$ in the anodic chamber after the dilution with $(N_1-3M_1)HCl$.

In the event that the ferric chloride composition must be regenerated after about $\frac{1}{4}$ $M_1$ of the original ferric ion concentration has been used to etch in order to maintain satisfactory etch rate, the composition of the spent etchant will then be $\frac{3}{4}$ $(M_1)$ ferric ion plus $\frac{3}{8}$ $(M_1)$ ferrous ion plus $N_1$ chloride ion plus $(N_1-3M_1)$ $H^+$ (as HCl).

In order to bring the combined concentration of ferric ions and ferrous ions to $M_1$, this spent composition would be diluted with $\frac{1}{8}$ $(V_1)$ liters of $(N_1-3M_1)HCl$. Then $V_1$ liters of the diluted etchant is transferred to the anodic compartment of the electrolytic cell. If desired, the catholyte in the cathodic compartment can be composed of the $\frac{1}{8}$ $V_1$ liters which is the remainder of the diluted etchant composition, together with $\frac{7}{8}$ $(V_1)$ liters of $N_1HCl$ to bring the total catholyte volume to $V_1$.

However, it is not necessary to employ the above types of compositions as the catholyte since the process of the present invention can be carried out employing any useful or sacrificial catholyte composition. In fact, one of the reaction at the cathode is not especially efficient in that the $E_o$ value for the reaction of ferrous ions to iron metal is extremely negative, about −0.71 volts versus a saturated calomel electrode. This results in a efficiency at the cathode of about 25% for the ferrous to iron metal reaction. Another reaction that occurs at the cathode is the reduction of ferric to ferrous ions. Accordingly, other catholyte compositions could be employed such as using an acid waste stream (neutralization). A further catholyte composition is to employ a spent copper plating or etchant composition for copper to plate out copper from the composition. The particular reaction involved in such is as follows:

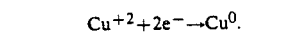

$$Cu^{+2}+2e^{-}\rightarrow Cu^{0}.$$

The regeneration carried out pursuant to the present invention can be performed under galvanostatic or potentiostatic control. In either case, anodic potential can be monitored via a reference electrode and prevented from exceeding preset limits by direct potential control or by reducing current flow as the limit is approached. This, in turn, prevents undesirable side reactions such as chlorine evolution. It is preferred, in accordance with the present invention, to provide turbulent flow of the anolyte near the anode surface to achieve highest reaction rate and efficiency.

In a plate and frame flow cell with an interelectrode gap of 0.5 to 5 mm, the flow rate typically ranges from about 25 to about 75 liters per minute per square meter of anode area.

In addition, the temperature of the anolyte is usually about 20° C. to about 75° C. and preferably about 25° C. to about 45° C. Also, it is preferred to carry out the entire process with a cell voltage of about 3 volts to about 20 volts and more typically about 3 to about 10 volts.

In addition, it is preferred to employ multiple cells stacked in series whereby the anolyte and catholyte solutions are recirculated through the anodic and cathodic compartments, respectively, of the cells multiple times until full regeneration is complete. The stacked plate and frame cell design provides for narrow electrode spacing, turbulent solution flow, and a high electrode area.

It has been observed that the preferred cell configurations employed by the present invention provide for the high efficiency and high reaction rates achieved by the present invention.

In addition, it is preferred in a plate and frame cell configuration that the electrode to membrane spacing be about 0.5 to about 20 mm.

In addition, the ion exchange membrane is usually about 0.05 mm to about 2 mm thick and preferably about 0.1 mm to about 0.2 mm thick.

The preferred compositions regenerated, according to the present invention, have an original composition before etching of about 5 to about 250 grams/liter of ferric ion, 0 to about 10 grams/liter of ferrous ion, and about 25 to about 500 grams/liter of chloride ion. Also, such compositions typically contain about 0.1 to 3 molar (about 5 to 100 grams/liter) HCl. Values of ferric and ferrous ions in the vicinity of the low end of the range (e.g.—5 grams/liter and 0 grams/liter, respectively) are typical for flash or microetchants. Values of ferric and ferrous ions in the vicinity of the upper end of the above ranges (about 250 grams/liter and 10 grams/liter) are typical for high speed etchants.

Typical spent compositions contain about 2 to about 200 grams/liter of ferric ions and about 2 to about 75 grams/liter of ferrous ions depending upon the composition of the composition prior to etching. Values in the vicinity of the low end are typical of spent flash etchants and those in the vicinity of the upper end are typical of spent high speed etchants. For instance, typical spent high speed etchants contain about 100 to about 200 grams/liter of ferric ions and about 25 to about 75 grams/liter of ferrous ions.

The following non-limiting examples are presented to further illustrate the present invention:

EXAMPLE 1

A 10 liter volume spent ferric chloride etching composition containing about 175 grams/liter of ferric ions and about 67 grams/liter of ferrous ions is diluted with HCl to reduce the total iron content (ferrous and ferric ions) down to the original value of 220 grams/liter.

About 10 liters of this diluted etchant composition is then introduced into the anode compartment of a two-chamber plate and frame type electrolytic flow cell. The catholyte introduced into the cathode compartment of the cell is the excess 1 liter of the diluted spent ferric chloride composition and about 9 liters of aqueous HCl of about 70 grams/liter HCl (about 2 normal).

The anode of the cell is DSA® oxygen pH <2 and the cathode is graphite felt. The size of the cathode is about 100 $cm^2$ and the size of the anode is about 100 $cm^2$. The ion exchange membrane is Neosepta AFN-32. The flow rate of the anolyte into the cell is about 1.1 liter/minute and the temperature of each is about 30° C.

The flow rate of the catholyte is about 2.6 liters/minute and the temperature of each is about 30° C. The current density at the anode is maintained at about 80 milliamps/$cm^2$ and the potential at the anode is monitored and is seen to be between +0.6 and +0.7 volts versus a saturated calomel electrode during the entire regeneration.

The regeneration is continued for about 4 hours, at which time a ferric chloride etchant composition containing about 220 grams/liter of ferric ions and only up to 1 gram/liter of ferrous ions is obtained. The efficiency of the anodic reaction to achieve the regeneration of ferric ions is about 100%. In the cathode compartment ferric ion is converted to ferrous ion and ferrous ion is converted to ferric metal, while hydrogen ion is converted to hydrogen gas.

The regenerated etchant composition exhibits a redox potential higher than that of the fresh etchant and performs at least as well as and, in some cases, better than fresh etchant. This may be due to the fact that fresh etchant typically contains about 5 grams/liter to about 10 grams/liter of ferrous ion, while the fully regenerated etchant composition contains as little as about 1 gram/liter of ferrous ion. The spent etchant compositions can be regenerated and reused at least 10 times sequentially and no etch rate decay has been observed for at least the first 7 regeneration-reuse cycles when etching stainless steel containing 14% chromium.

The following table illustrates the redox potentials of the fresh, spent, and regenerated etchants:

| Etchant | OXYGEN REDOX POTENTIAL (Volts vs. Ag/AgCl reference The workinq electrode is platinum) |
|---|---|
| Fresh | 620–630 |
| Spent | 520–550 |
| Regenerated | 650–690 |

EXAMPLE 2

Example 1 is repeated, except that the ion exchange membrane is ESC 7001. The results achieved are similar to those of Example 1, except that they are not quite as good in that the efficiency of the regeneration reaction is slightly less due to a selectivity of the membrane to ferric ion of about 97% as compared to 100% in Example 1.

EXAMPLE 3

Example 1 is repeated, except that the ion exchange membrane employed is Ionac. The results achieved are similar to those of Example 2.

EXAMPLE 4

Example 1 is repeated, except that the anode employed is a platinum-iridium. The results achieved are similar to those of Example 1.

EXAMPLE 5

Example 1 is repeated, except that the catholyte is a hydrochloric acid solution containing about 70 grams/liter of chloride ions. The results achieved are similar to those of Example 1. The pH of the acid in the catholyte is observed to increase due to hydrogen evolution.

EXAMPLE 6

Example 1 is repeated, except that the catholyte composition is a spent acid copper plating bath composition containing about 16 grams/liter of cuprous ions. The results achieved are similar to those of Example 1. Copper is plated on the cathode at high efficiency during regeneration.

Having thus described our invention, what we claim as new and desire to secure by Letters Patent is:

1. A method for regenerating a spent ferric chloride etching composition without generating chlorine gas which comprises:

providing an electrolysis cell having an anode compartment containing an anode, a cathode compartment containing a cathode, and an anion-exchange membrane separating the cathode compartment from the anode compartment;

introducing an anolyte comprising spent ferric chloride etching composition into the anode compartment and introducing a catholyte into said cathode compartment;

said spent ferric chloride etching composition having a total iron concentration that is substantially equal to the original total iron concentration of the original ferric chloride etching composition before etching;

applying a voltage of +0.6 volts to +1.5 volts versus a saturated calomel electrode to said anode to thereby oxidize ferrous ions to ferric ions and thereby regenerating the spent ferric chloride etching composition.

2. The method of claim 1 wherein said spent ferric chloride is diluted with water and HCl to obtain said total iron concentration.

3. The method of claim 1 wherein said spent ferric chloride is diluted by about 1/10 to about ¼ by volume with water and HCl to obtain said total iron concentration.

4. The method of claim 1 wherein said spent ferric chloride is diluted by about ⅛ to about ¼ by volume with water and HCl.

5. The method of claim 1 wherein said catholyte includes excess diluted spent ferric chloride and HCl.

6. The method of claim 1 wherein the anode is of platinum and iridium oxide on titanium substrate.

7. The method of claim 1 wherein the cathode is of graphite felt.

8. The method of claim 1 wherein the flow rate of the anolyte to the cell is about 10 to about 200 liter/minute.

9. The method of claim 1 wherein the temperature of the anolyte is about 20° C. to about 75° C.

10. The method of claim 1 wherein the cell has a voltage of about 3 to about 20 volts.

11. The method of claim 1 being carried out in at least two cells stacked in series.

12. The method of claim 1 wherein said membrane is polydivinyl benzene having quaternary or tertiary ammonium salt ion exchange groups.

13. The method of claim 1 wherein the regeneration is potentiostatically controlled.

* * * * *